US011613333B2

(12) United States Patent
Hong

(10) Patent No.: US 11,613,333 B2
(45) Date of Patent: Mar. 28, 2023

(54) WATERCRAFT SAFETY FLAG

(71) Applicant: Bear USA, Inc., Palisades Park, NJ (US)

(72) Inventor: Albert Beom Joon Hong, Alpine, NJ (US)

( * ) Notice: Subject to any disclaimer, the term of this patent is extended or adjusted under 35 U.S.C. 154(b) by 300 days.

(21) Appl. No.: 16/933,023

(22) Filed: Jul. 20, 2020

(65) Prior Publication Data

US 2021/0024185 A1 Jan. 28, 2021

Related U.S. Application Data

(60) Provisional application No. 62/877,058, filed on Jul. 22, 2019.

(51) Int. Cl.
*B63B 45/04* (2006.01)
*G09F 17/00* (2006.01)

(52) U.S. Cl.
CPC ..... *B63B 45/04* (2013.01); *G09F 17/00* (2013.01); *G09F 2017/005* (2013.01); *G09F 2017/0033* (2013.01); *G09F 2017/0058* (2013.01); *G09F 2017/0075* (2013.01); *G09F 2017/0083* (2013.01)

(58) Field of Classification Search
CPC ..... B63B 45/04; B63B 2201/00; G09F 17/00; G09F 2017/0033; G09F 2017/005; G09F 2017/0058; G09F 2017/0075; G09F 2017/0083
See application file for complete search history.

(56) References Cited

U.S. PATENT DOCUMENTS 1,646,467 A * 10/1927 Walton ..... E04H 12/32 40/617
2,688,303 A * 9/1954 Leander ..... G09F 17/00 40/604
2,732,823 A 1/1956 Hanson
2,856,891 A 10/1958 Solomon
2,905,140 A 9/1959 Acklam
3,091,215 A 5/1963 Kenmore
(Continued)

OTHER PUBLICATIONS

Product offering: VISICarbon Pro™, MightyMount and GearTrac™ ready (CPM), found at: https://www.yakattack.us/CPM_p/cpm.htm, Jan. 1, 2019.

*Primary Examiner* — John Fitzgerald
*Assistant Examiner* — Tania Courson
(74) *Attorney, Agent, or Firm* — David M. Quinlan, P.C.

(57) ABSTRACT

A watercraft safety flag assembly comprising a flexible planar visibility-enhancing element having a forward edge and a rear edge spaced from the forward edge by a width, and a rigid planar stiffening element secured to the flexible planar visibility-enhancing element, where the planar stiffening element substantially spans the width of the flexible planar visibility-enhancing element and is configured to provide maximum stiffening proximate the forward edge, minimal stiffening proximate the rear edge, and decreasing stiffening with increasing distance from the forward edge. There is also provided a header element joined to the forward edge of the flexible planar visibility-enhancing element and which forms a cylindrical sleeve for receiving a mast, where the rigid planar stiffening element extends into the cylindrical sleeve formed by the header element.

20 Claims, 3 Drawing Sheets

(56) References Cited

U.S. PATENT DOCUMENTS 3,127,869 A * 4/1964 Howland ..... G09F 17/00 116/173
3,323,486 A 6/1967 Woolf
3,595,202 A 7/1971 Visitacion
4,024,833 A 5/1977 Pook et al.
4,574,726 A * 3/1986 Sullivan ..... B60R 13/005 116/28 R
4,603,652 A 8/1986 Thibault et al.
4,606,070 A * 8/1986 Schachter ..... A45C 9/00 383/4
4,700,655 A 10/1987 Kirby
4,727,822 A * 3/1988 Wikkerink ..... G09F 17/0091 116/28 R
4,813,369 A * 3/1989 Moreland ..... G08B 5/00 24/442
4,906,503 A * 3/1990 De La Cruz ..... G09F 15/0018 40/604
5,291,849 A * 3/1994 Zeitler ..... G09F 17/00 116/173
5,402,746 A 4/1995 Deschamps
5,522,165 A * 6/1996 Molla ..... G09F 17/00 40/604
5,615,635 A * 4/1997 Deviney ..... A63B 57/40 116/173
5,740,622 A * 4/1998 Martin ..... G09F 21/04 116/28 R
5,865,355 A * 2/1999 Camara ..... A45F 4/02 256/25
5,884,578 A 3/1999 Thostrup et al.
5,930,956 A * 8/1999 Trosper ..... E04G 21/30 135/97
6,176,642 B1 * 1/2001 Hinterholzer ..... A63C 19/062 40/608
6,584,928 B2 7/2003 Kinahan
7,017,512 B2 3/2006 Laird et al.
7,424,864 B2 9/2008 McCann
7,552,696 B1 * 6/2009 DeFord ..... G09F 17/00 116/173
8,881,669 B2 * 11/2014 Horvath ..... G09F 17/00 116/174
9,216,802 B2 12/2015 Larouche et al.
2006/0163552 A1 * 7/2006 Jacobs ..... A63C 19/062 256/24
2007/0089663 A1 4/2007 Dunbar et al.
2017/0316723 A1 11/2017 Muir

* cited by examiner

WATERCRAFT SAFETY FLAG

CROSS-REFERENCE TO RELATED APPLICATION

This application claims the benefit of U.S. Provisional Application No. 62/877,058, filed Jul. 22, 2019.

BACKGROUND OF THE INVENTION

Field of the Invention

This invention relates to a visibility-enhancing safety feature for watercraft.

Description of the Related Art

Kayaking is a popular sport for exercise, fishing and enjoyment of the water. However, kayaks generally float low in the water and thus can often be partly or totally obscured from view by waves or ocean swell. This can create a potentially dangerous situation, such as where relatively high speed motorcraft may not observe a kayaker with sufficient time to take evasive action.

SUMMARY OF THE INVENTION

The present invention provides an assembly with the goal of making kayaks and other small watercraft more visible to other boaters, particularly motorcraft.

In one aspect, the invention is directed to a watercraft safety flag assembly comprising a flexible planar visibility-enhancing element having a forward edge and a rear edge spaced from the forward edge by a width, and a rigid planar stiffening element secured to the flexible planar visibility-enhancing element, where the planar stiffening element substantially spans the width of the flexible planar visibility-enhancing element and is configured to provide maximum stiffening proximate the forward edge, minimal stiffening proximate the rear edge, and decreasing stiffening with increasing distance from the forward edge. There is also provided a header element joined to the forward edge of the flexible planar visibility-enhancing element and which forms a cylindrical sleeve for receiving a mast, where the rigid planar stiffening element extends into the cylindrical sleeve formed by the header element.

These and other aspects of the present invention are described in the drawings annexed hereto, and in the description of the preferred embodiments and claims set forth below.

DETAILED DESCRIPTION OF THE PREFERRED EMBODIMENTS

Figure 1:
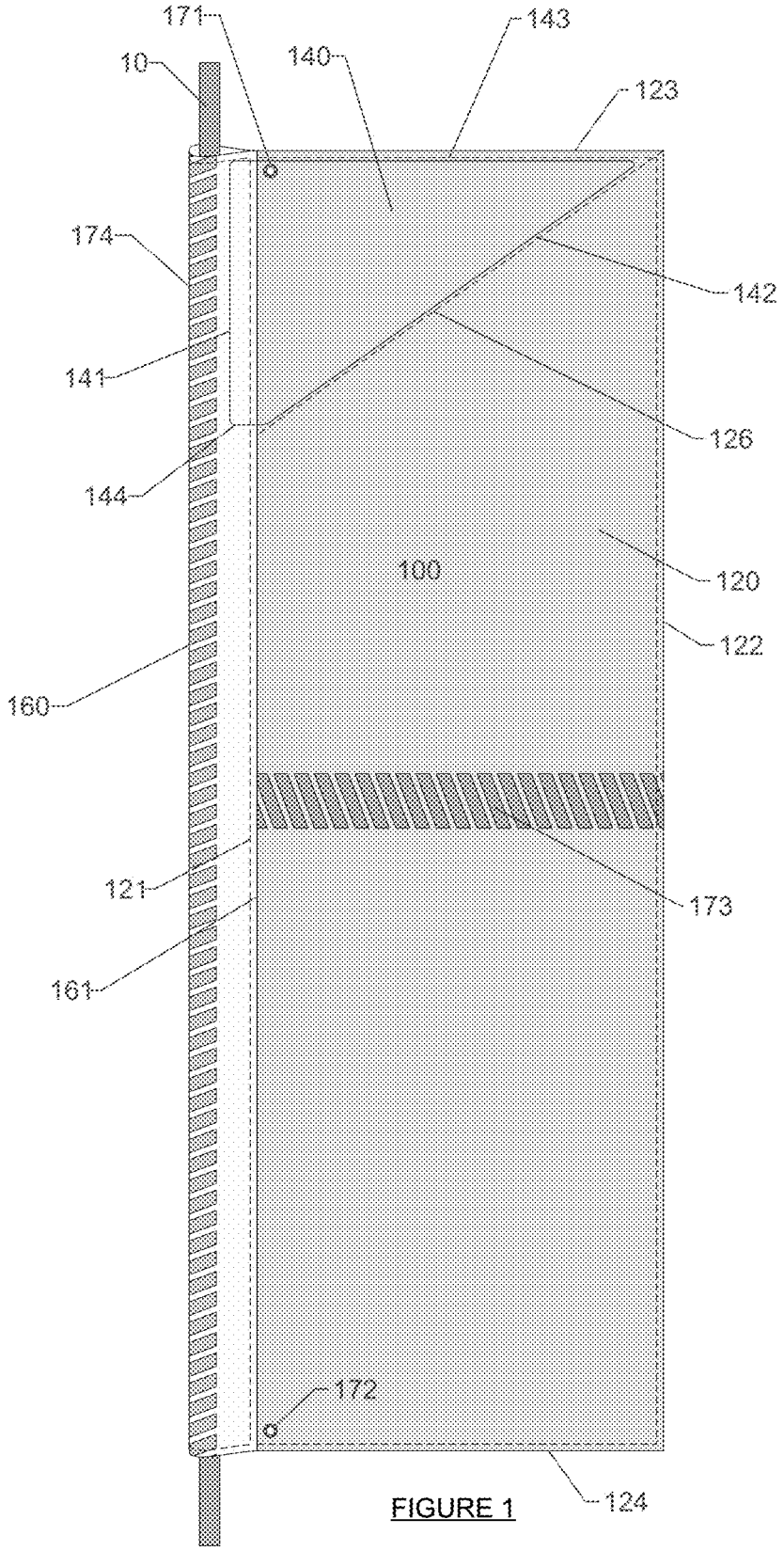
FIG. 1 depicts a plan view of the watercraft safety flag of the present invention affixed to a mast.

FIG. 1 depicts watercraft safety flag assembly 100, which comprises three principal sections: fabric section 120, stiffener section 140 and header section 160. Assembly 100 is depicted in FIG. 1 as secured to a rod or mast 10. Mast 10 is secured to and extends from the hull of a watercraft, such as a small watercraft and particularly a kayak. Mast 10 is principally oriented in the vertical direction, meaning that it is oriented within 45 degrees of perpendicular to the surface of the water over which the watercraft is propelled; the vertical direction accordingly includes orientations exactly perpendicular as well as approximately perpendicular to that surface.

Fabric section 120 in the embodiment shown in the figures is a generally rectangular material with a forward edge 121, a rear edge 122, a top edge 123 and a bottom edge 124. It is preferred that fabric section 120 be a convex quadrilateral in shape, such as a trapezoid, and more preferably an isosceles trapezoid with forward edge 121 generally parallel to rear edge 122. It is particularly preferred that fabric section 120 be rectangular in shape, as shown in the figures. The purpose of fabric section 120 is to make the watercraft more visible to other boaters, particularly those in motorboats. Forward edge 121 of safety flag assembly 100 is proximate to and aligned along the length of mast 10, whereas rear edge 122 is distal from mast 10. In the embodiment shown in the figures, the ratio of the length of edges 121/122 to edges 123/124, referred to herein as the aspect ratio of fabric section 120, can be varied in accordance with design choice. It is preferred that the aspect ratio of fabric section 120 be greater than one, and more particularly greater than three. In a currently preferred embodiment, the aspect ratio of fabric section 120 is approximately 3.2.

Fabric section 120 is a thin woven or film fabric of sufficient flexibility that, if held along forward edge 121 in a wind, it will flap in the manner of a flag. It is preferred that fabric section 120 be made of materials resistant to ultraviolet light and the marine environment. Suitable materials for fabric section 120 include UV resistant fabrics such as polyester mesh. Fabric section 120 can comprise two substantially similar panels joined along a center fold.

Figure 2A:
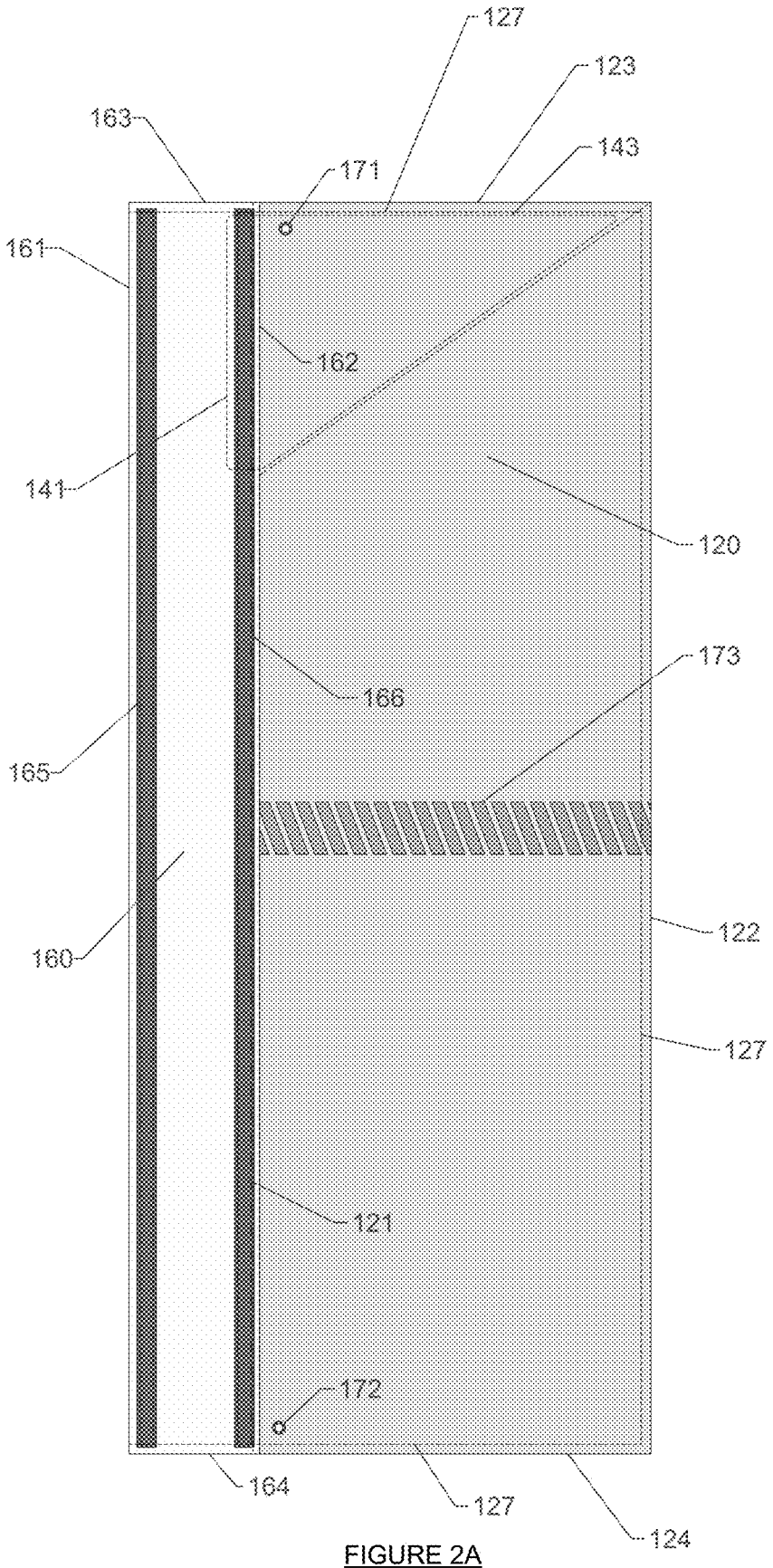
FIG. 2A is a plan view of the obverse face of the watercraft safety flag of the present invention.
Figure 2B:
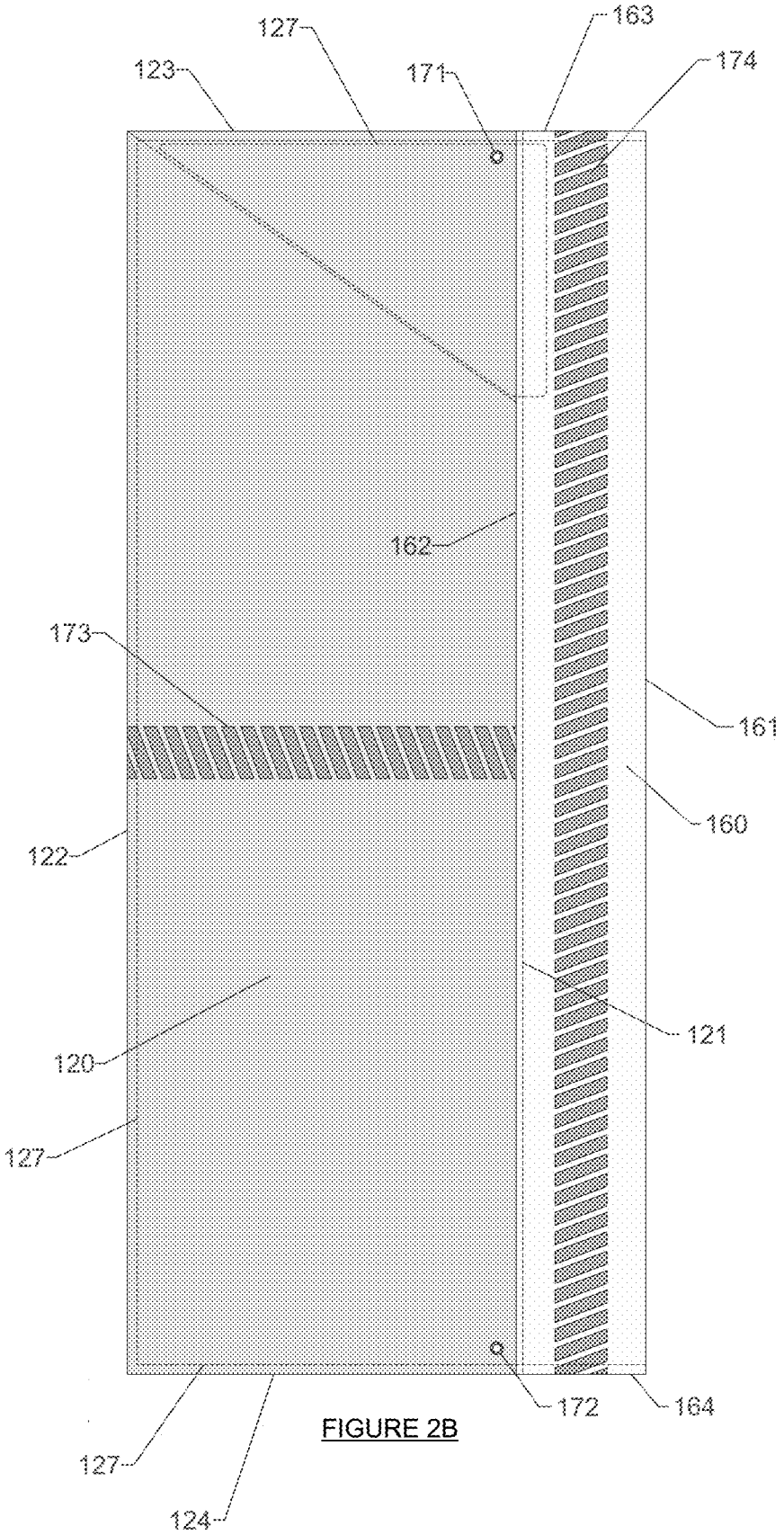
FIG. 2B is a plan view of the reverse face of the watercraft safety flag of the present invention.

As shown in FIGS. 2A and 2B, header section 160 is a rectangular flexible material having a first edge 161, a second edge 162, a top edge 163 and a bottom edge 164. The purpose of header section 160 is to provide means to secure watercraft safety flag assembly 100 to mast 10. Second edge 162 is joined to forward edge 121 of fabric section 120 as for example by stitching. Inset and adjacent to each of first edge 161 and second edge 162, there are provided mating pairs of fastener sections 165, 166, shown in FIG. 2A, such as "Velcro" hook and loop fasteners. The length of top and bottom edges 163 and 164 are sufficient to permit header section 160 to be wrapped around mast 10 and fastener sections 165, 166 to be superposed and mated, so as to secure watercraft flag assembly 100 to mast 10, while permitting the removal of flag assembly 100 when desired. It is preferred that the aspect ratio of header section 160 (ratio of the length of edges 161/162 to edges 163/164) be greater than nine, and in a currently preferred embodiment is approximately 9.6.

Header section 160 is a fabric that is sufficiently robust to resist abrasion from mast 10. Suitable materials for header section 160 include flexible materials such as polyester oxford weave fabrics from 200 to 400 denier yarn thickness, designed for outdoor use and resistant to UV, provided with a polyurethane coating of a type commonly used in such applications.

Stiffener section 140, shown in FIG. 1 in solid lines for purposes of illustration, is a planar sheet with a vertical side 141, a horizontal side 143, and a hypotenuse 142 joining sides 141 and 143. It is preferred that sides 141 and 143 subtend an angle of approximately 90 degrees, although obtuse or acute angles can be appropriate in certain circumstances, such as to accommodate the particular shape of fabric section 120. The purpose of stiffener section 140 is to keep fabric section 120 extended from mast 10 in light or no wind situations, so that safety flag assembly 100 remains visible in those situations to other boaters. Stiffener section 140 is positioned in the upper portion of fabric section 120, with vertical side 141 generally parallel to forward edge 121 of fabric section 120, and horizontal side 143 generally parallel and proximate to top edge 123 of fabric section 120. As can be seen, the vertical distance between horizontal side 143 and hypotenuse 142 is at a maximum proximate to forward edge 121 of fabric section 120, at a minimum (in the preferred embodiment, approximately zero) proximate rear edge 122 of fabric section 120, and decreases with increasing distance from forward edge 121.

Stiffener section 140 has sufficient rigidity to support fabric section 120 in an extended position. As a consequence of its triangular shape and orientation, stiffener section 140 provides maximum stiffening to fabric section 120 proximate to forward edge 121, minimum stiffening proximate rear edge 122, and decreasing stiffening with increasing distance from forward edge 121. Stiffener section 140 can be formed from a sheet of rigid plastic, such as high density polyethylene (HDPE) or polystyrene. It is particularly preferred that vertical side 141 of stiffener section 140 extend into the cylindrical space defined by header section 160 when fastener sections 165, 166 are superposed and mated (such as when flag assembly 100 is secured to mast 10), with the major portion of horizontal side 143 being positioned between the two panels of fabric section 120 and generally parallel and proximate to top edge 123, as shown in FIG. 1. The lower portion of vertical side 141 optionally is provided with a chamfer 144, as shown in FIG. 1.

In the preferred embodiment, flag assembly 100 is made from a generally rectangular polyester mesh fabric starting piece. The starting piece can be fashioned with contrasting color patterns to improve visibility, such as by providing areas colored fluorescent green and hexachrome orange C arranged for example in stacked or checkboard patterns. To prepare fabric section 120, the starting piece is folded in half along a center fold, to form fabric section 120 having two overlying panels bounded by forward edge 121, rear edge 122, top edge 123 and bottom edge 124. In the preferred embodiment, edges 121 and 122 are approximately 24 inches in dimension and edges 123 and 124 are approximately 7.5 inches in dimension. Also in the preferred embodiment, triangular stiffener section 140 is cut from a sheet of HDPE 0.0625 inch thick. Stiffener section 140 is positioned between the panels of fabric section 120 at the upper portion of fabric section 120, as shown in the figures, and is maintained in place by for example diagonal stitching 126 (shown in FIG. 1), which together with stitching 127 adjacent top edge 123 of fabric section 120 (shown in FIGS. 2A, 2B) forms a pocket for receiving stiffener section 140. Stitching 127 (FIGS. 2A, 2B) can also be provided adjacent bottom edge 124 and rear edge 122 of fabric section 120.

As shown in FIGS. 1, 2A and 2B, a horizontally-oriented reflective band 173 can be secured to each side of fabric section 120 to further improve visibility. Suitable materials for reflective band 173 include 3M reflective material—8712 silver transfer film, which can be secured to fabric section 120 by use of heat.

In the preferred embodiment, header section 160, shown in FIGS. 2A and 2B, is a fabric approximately 24 inches long by 2.5 inches wide. In that preferred embodiment, fastener sections 165, 166 are respectively secured proximate first and second edges 161, 162 of header section 160, for example by adhesive or a vertical line or lines of stitching, and second edge 162 of header section 160 is secured to the two panels of fabric section 120 proximate forward edge 121 by for example a vertical line or lines of stitching. It is particularly preferred that such a vertical line or lines of stitching, or another vertical line or lines of stitching, also pass through stiffener section 140 (and the two panels of fabric section 120) in the region proximate to vertical side 141, in the case where vertical side 141 extends into the cylindrical space defined by header section 160 when fastener sections 165, 166 are superposed and mated (as shown for example in FIG. 1). The vertical stitching serves to fixedly secure stiffener section 140 to the upper portion of fabric section 120, with the goal of enhancing rigidity and extending the useful life of flag assembly 100.

As shown in FIGS. 1 and 2B, a vertically-oriented reflective band 174 can be secured to header section 160 to further improve visibility. Like reflective band 173, suitable materials for reflective band 174 include 3M Reflective Material—8712 Silver Transfer Film, which can be secured to header section 160 by use of heat.

Optionally, a top grommet 171 (in the preferred embodiment having a 0.5 inch outside diameter and a 0.25 inch inside diameter) can be positioned proximate the intersection of forward edge 121 and top edge 123 of fabric section 120, as shown in the figures. Top grommet 171 provides a small aperture through the upper portion of fabric section 120 and through stiffener section 140, which can be utilized as a tying point to assist in positioning safety flag assembly 100 at a desired vertical position on mast 10. Top grommet 171 can be made of brass, UV resistant plastic or other material suitable for a marine environment. A like bottom grommet 172 can optionally be positioned proximate the intersection of forward edge 121 and bottom edge 124 of fabric section 120, as shown in the figures, to be utilized as a tying point to assist in fixing safety flag assembly 100 at a fixed position on mast 10.

The foregoing detailed description is for illustration only and is not to be deemed as limiting the inventions, which are defined in the appended claims.

What is claimed is:

1. A watercraft safety flag assembly comprising:

a flexible planar visibility-enhancing element having a forward edge and a rear edge spaced from the forward edge by a width of a top edge;

a header element joined to the forward edge of the flexible planar visibility-enhancing element and forming a cylindrical sleeve for receiving a rod or mast of a watercraft; and a rigid planar stiffening element supporting the flexible planar visibility-enhancing element proximate the top edge and substantially spanning the width of the flexible planar visibility-enhancing element from proximate the forward edge to proximate the rear edge, wherein the planar stiffening element is configured to provide maximum stiffening proximate the forward edge, minimal stiffening proximate the rear edge and decreasing stiffening with increasing distance from the forward edge, and is secured to the forward edge of the flexible planar visibility element proximate the cylindrical sleeve formed by the header element.

2. The watercraft safety flag assembly of claim 1, wherein the rigid planar stiffening element is a triangular sheet comprising first and second sides subtending a right angle and forming said first and second sides of the rigid planar stiffening element.

3. The watercraft safety flag assembly of claim 2, wherein:

the flexible planar visibility-enhancing element includes a fold forming the rear edge of the visibility-enhancing element and approximately evenly dividing the visibility-enhancing element into two substantially coextensive panels joined at the fold, and the right-triangular sheet is positioned between the panels of the flexible planar visibility-enhancing element with the second side of the right-triangular sheet extending into the interior of the cylindrical sleeve and secured to the two panels by a line of stitching proximate the top edge of the visibility-enhancing element.

4. The watercraft safety flag assembly of claim 1, wherein the flexible planar visibility-enhancing element comprises a woven fabric.

5. The watercraft safety flag assembly of claim 4, wherein the woven fabric is a polyester mesh.

6. The watercraft safety flag assembly of claim 4, further comprising a light-reflective region affixed to a portion of the woven fabric.

7. The watercraft safety flag assembly of claim 4, wherein the woven fabric includes a fold forming the rear edge of the flexible planar visibility-enhancing element and approximately evenly dividing the woven fabric into two substantially coextensive panels joined at the fold.

8. The watercraft safety flag assembly of claim 7, further comprising a line of stitching passing through the two panels and the rigid planar stiffening element proximate the forward edge of the visibility-enhancing element.

9. The watercraft safety flag assembly of claim 7, wherein the aspect ratio of the flexible planar visibility-enhancing element is greater than three.

10. The watercraft safety flag assembly of claim 1, wherein the header element comprises a flexible material.

11. The watercraft safety flag assembly of claim 10, wherein the header element has a first edge joined to the forward edge of the flexible planar visibility-enhancing element and a second edge adapted to be removably fastened to a portion of the header element proximate the first edge of the header element to form the cylindrical sleeve.

12. The watercraft safety flag assembly of claim 11, further comprising a first fastener section secured to the header element proximate to the first edge of the header element and a second fastener section secured to the header element proximate to the second edge of the header element, wherein the first fastener section and the second fastener section removably adhere to each other.

13. The watercraft safety flag assembly of claim 12, further comprising a light-reflective region affixed to a portion of the header element.

14. The watercraft safety flag assembly of claim 12, wherein the first and second fastener sections respectively comprise hook and loop fasteners.

15. The watercraft safety flag assembly of claim 14, wherein the header element is generally rectangular in shape with a width separating the first edge and the second edge, and the aspect ratio of the header element is greater than nine.

16. A watercraft safety flag assembly comprising:

a two-panel flexible fabric visibility-enhancing element having a forward edge, a top edge and a rear edge;

a flexible fabric header element having a first edge joined to the forward edge of the visibility-enhancing element and a second edge adapted to be removably fastened to a portion of the header element proximate the first edge of the header element to form a cylindrical sleeve for receiving a rod or mast of a watercraft; and a rigid planar triangular stiffening sheet disposed between the panels of the visibility-enhancing element, the triangular stiffening sheet having first and second sides subtending a generally right angle, with a major portion of the first side positioned generally parallel and proximate to the top edge of the visibility-enhancing element, and the second side positioned generally parallel to the forward edge of the visibility-enhancing element, wherein:

the second side of the triangular stiffening sheet extends from a proximal end in the interior of the cylindrical sleeve formed by the header element to a distal end proximate the rear edge of the visibility-enhancing element, the stiffening sheet is secured between the two panels of the visibility-enhancing element by a line of stitching passing through the two panels and the triangular stiffening sheet proximate the forward edge of the visibility-enhancing element, and the triangular stiffening sheet maintains the flexible fabric visibility-enhancing element extended from the mast without supporting the front edge of the visibility-enhancing element.

17. The watercraft safety flag assembly of claim 16, further comprising a chamfer in the second side of the triangular stiffening sheet distal from the generally right angle.

18. The watercraft safety flag assembly of claim 16, wherein the flexible fabric of the visibility-enhancing element is a woven polyester mesh.

19. The watercraft safety flag assembly of claim 18, further comprising a first grommet proximate an intersection of the forward edge and top edge of the visibility-enhancing element to provide a through-hole through the watercraft safety flag assembly.

20. The watercraft safety flag assembly of claim 19, further comprising a second grommet proximate an intersection of the forward edge and a bottom edge of the visibility-enhancing element to provide a through-hole through the watercraft safety flag assembly.

* * * * *